US007605526B2

(12) United States Patent
Ishinada et al.

(10) Patent No.: US 7,605,526 B2
(45) Date of Patent: Oct. 20, 2009

(54) SPARK PLUG FOR INTERNAL COMBUSTION ENGINE

(75) Inventors: Teiji Ishinada, Chiryu (JP); Tsunenobu Hori, Kariya (JP)

(73) Assignee: Denso Corporation, Kariya (JP)

( * ) Notice: Subject to any disclaimer, the term of this patent is extended or adjusted under 35 U.S.C. 154(b) by 311 days.

(21) Appl. No.: 11/654,651

(22) Filed: Jan. 18, 2007

(65) Prior Publication Data

US 2007/0188065 A1 Aug. 16, 2007

(30) Foreign Application Priority Data

Feb. 13, 2006 (JP) ..... 2006-035399
Sep. 29, 2006 (JP) ..... 2006-266829

(51) Int. Cl.
*H01T 13/20* (2006.01)

(52) U.S. Cl. ..... 313/142; 313/141; 123/169 EL

(58) Field of Classification Search ..... 313/141–143; 123/169 EL
See application file for complete search history.

(56) References Cited

U.S. PATENT DOCUMENTS 6,707,237 B2 3/2004 Teramura et al.
2003/0038575 A1* 2/2003 Hori et al. ..... 313/141
2003/0071552 A1* 4/2003 Teramura et al. ..... 313/143
2004/0041506 A1* 3/2004 Teramura et al. ..... 313/141
2005/0057134 A1* 3/2005 Kanao et al. ..... 313/141
2005/0168120 A1* 8/2005 Kanao et al. ..... 313/118
2006/0213474 A1* 9/2006 Sugiyama et al. ..... 123/169 EL

FOREIGN PATENT DOCUMENTS

JP 2001-307858 11/2001

* cited by examiner

*Primary Examiner*—Bumsuk Won
(74) *Attorney, Agent, or Firm*—Nixon & Vanderhye P.C.

(57) ABSTRACT

A spark plug for an internal combustion engine is disclosed having a metal shell having an outer periphery formed with a mounting thread, a porcelain insulator fixedly secured to the metal shell on a central axis thereof, a center electrode retained within the porcelain insulator along a central axis thereof with a distal end located outside the porcelain insulator, and a ground electrode joined to the metal shell and having an end associated with the distal end of the center electrode to define therebetween a spark discharge gap. The ground electrode includes a facing surface intersecting the central axis of the center electrode and having a width equal to or less than 1.6 mm.

7 Claims, 10 Drawing Sheets

SPARK PLUG FOR INTERNAL COMBUSTION ENGINE

CROSS REFERENCE TO RELATED APPLICATIONS

This application is based on Japanese Patent Application Nos. 2006-35399, filed on Feb. 13, 2006, and 2006-266829, filed on Sep. 29, 2006, the contents of which are hereby incorporated by reference.

BACKGROUND OF THE INVENTION

1. Field of the invention

The present invention relates to spark plugs for internal combustion engines and, more particularly, to a spark plug for use in a motor vehicle, a cogeneration system and a gas pressure feed pump or the like.

2. Description of the Related Art

In the related art, attempts have heretofore been made to provide spark plugs for use in internal combustion engines to be used as igniting means of the internal combustion engines of motor vehicles or the like.

The spark plugs usually include center electrodes and ground electrodes between which spark discharge gaps are provided. Applying a high voltage across the center electrode and the ground electrode allows a spark discharge to take place in the spark discharge gap, thereby igniting an air-fuel mixture.

In recent years, with an increasing demand for a low fuel consumption and high power output ratio needed for the engine of the motor vehicle, modern motor vehicles generally employ direct fuel-injection type engines each arranged to directly inject fuel into a combustion chamber of the engine. With such an arrangement, there has been an increasing trend in which an air fuel mixture, supplied to a combustion chamber, has an increased concentration of fuel in areas near the center electrode and the ground electrode around the spark discharge gap.

Therefore, this causes fuel of the air-fuel mixture to adhere onto the center electrode and the ground electrode especially at areas around the spark discharge gap. In particular, a tendency has occurred for fuel to adhere onto a surface of the ground electrode due to its large exposed area. This results in a phenomenon wherein fuel, adhered onto the surface of the ground electrode, flows along the surface of the ground electrode to a facing surface placed in face-to-face relationship with a distal end of the center electrode and clumps on the ground electrode. This causes a risk to occur for fuel of the air-fuel mixture to clump at the facing surface of the ground electrode (in a manner referred to as fuel clamping) at an increased fuel clamping rate. Another risk takes place for fuel of the air-fuel mixture clumped at the facing surface of the ground electrode causing a bridging to take place in the spark discharge gap to make connection between the distal end of the center electrode and the facing surface of the ground electrode (in a manner referred to as fuel bridging).

Such risks become serious especially when starting up the engine in an extremely low temperature environment, under which fuel clamping and fuel bridging are liable to occur at increased incidence rates.

With a view to addressing such an issue, an attempt has heretofore been made to provide a spark plug formed in a structure including a center electrode and a ground electrode both of which carries thereon noble metal chips formed in respective narrowed outer diameters for thereby suppressing the occurrence of fuel bridging (see Japanese Unexamined patent Application Publication No. 2001-307858).

However, even with such a spark plug being employed, an issue still arises especially in the direct fuel-injection type engine of the type discussed above in that the spark plug suffers the occurrence of fuel clamping and fuel bridging. Further, the provision of the spark plug with both of the center electrode and the ground electrode carrying thereon the noble metal chips results in an increase in man-hours and production.

In addition, it is conceived that fuel clamping and fuel bridging occur on the spark plug due to shapes of or positional relationship between the center electrode and the ground electrode. Thus, it can be considered that there still exists a room left for improvement of the spark plug in respect of the ground electrode.

SUMMARY OF THE INVENTION

The present invention has been completed with the above view in mind and has an object to provide a spark plug for an internal combustion engine which spark plug has an excellent fuel clamping resistance and fuel bridging resistance.

To achieve the above object, one aspect of the present invention provides a spark plug for an internal combustion engine, comprising a metal shell having an outer periphery formed with a mounting thread, and a porcelain insulator fixedly secured to the metal shell on a central axis thereof. A center electrode is retained within the porcelain insulator along a central axis thereof with a distal end located outside the porcelain insulator. A ground electrode is joined to the metal shell and has an end associated with the distal end of the center electrode to define therebetween a spark discharge gap. The ground electrode includes a facing surface intersecting the central axis of the center electrode and has a width equal to or less than 1.6 mm.

With the spark plug set forth above, the facing surface of the ground electrode is set to have a width equal to or less than 1.6 mm. Therefore, even if fuel is caused to adhere onto the facing surface of the ground electrode in a specified area around the spark discharge gap, fuel is liable to flow out of the specified area into side areas. In addition, even if fuel is adhered onto the ground electrode and flows to the facing surface thereof, this fuel flows into the side areas of the facing surface. Thus, fuel becomes hard to clamp onto the facing surface in the specified area. This results in capability of suppressing the occurrence of fuel clamping, while making it possible to minimize the occurrence of fuel bridging. Thus, the spark plug can have increased ignitability and startability.

As set forth above, the present invention makes it possible to provide a spark plug for an internal combustion engine with increased fuel clamping resistance and fuel bridging resistance.

BRIEF DESCRIPTION OF THE DRAWINGS

For a better understanding of the present invention and to show how the same may be carried into effect, there will now be described by way of example only, specific embodiments according to the present invention with reference to the accompanying drawings, in which.

DETAILED DESCRIPTION OF THE PREFERRED EMBODIMENTS

Figure 1:
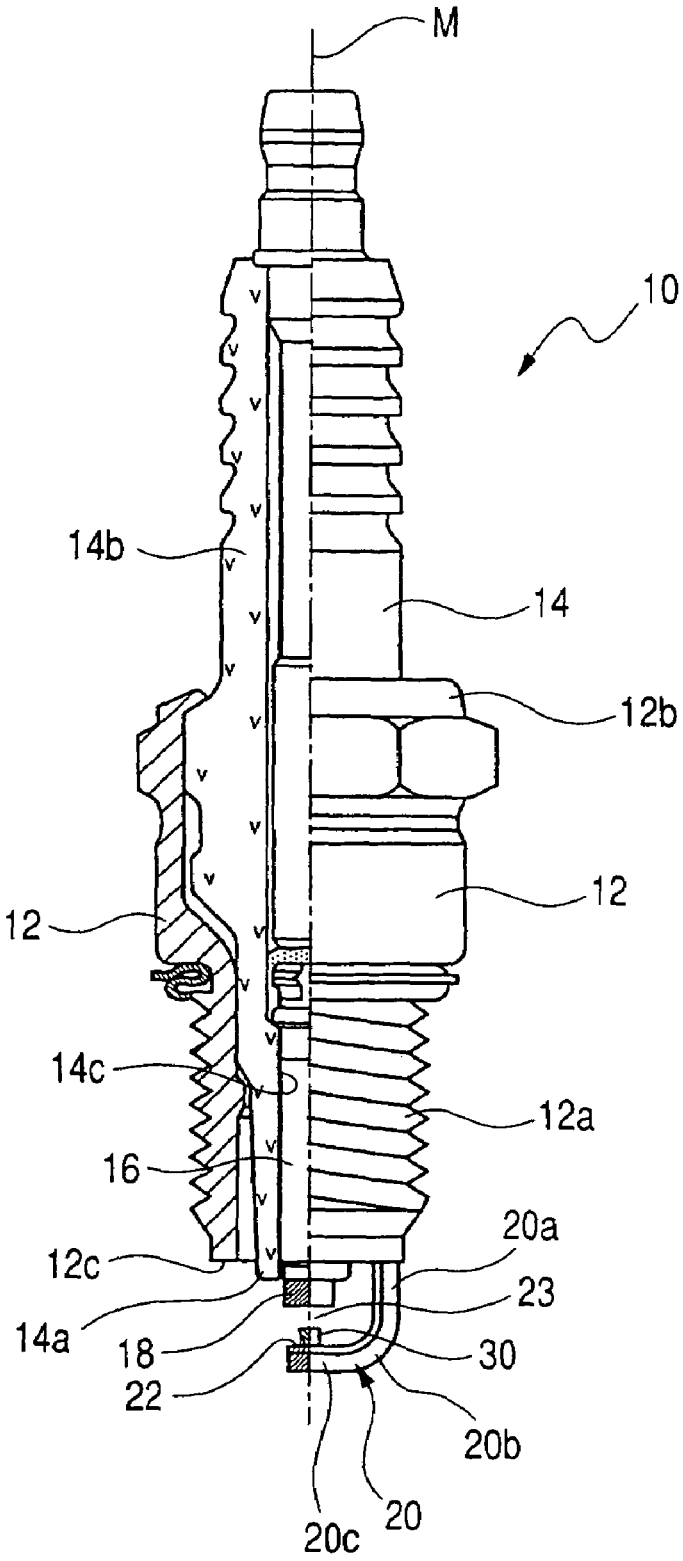
FIG. 1 is a partially cross sectional view showing a spark plug of a first embodiment according to the present invention.

Now, spark plugs of various embodiments according to the present invention are described below in detail with reference to the accompanying drawings. However, the present invention is construed not to be limited to such embodiments described below and technical concepts of the present invention may be implemented in combination with other known technologies or the other technology having functions equivalent to such known technologies.

In the following description, like reference characters designate like or corresponding parts throughout the several views. Also in the following description, description on the same component parts of one embodiment as those of another embodiment is omitted, but it will be appreciated that like reference numerals designate the same component parts throughout the drawings.

First Embodiment

A spark plug of a first embodiment according to the present invention is described below in detail with reference to FIG. 1 to 3 of the accompanying drawings.

FIG. 1 is a semi-cross sectional view illustrating an overall structure of the spark plug 10 of the first embodiment according to the present invention; FIG. 2 is an enlarged side view illustrating an area around an igniting section of the spark plug 10; and FIG. 3 is an enlarged front view illustrating an area around the igniting section of the spark plug 10

The spark plug 10 may be used as an igniting means of an internal combustion engine to be used in, for instance, a motor vehicle, a cogeneration system and a gas pressure feed pump or the like with the engine having an engine head (not shown) formed with a threaded bore to which the spark plug of the present invention is screwed in a fixed place.

Figure 2:
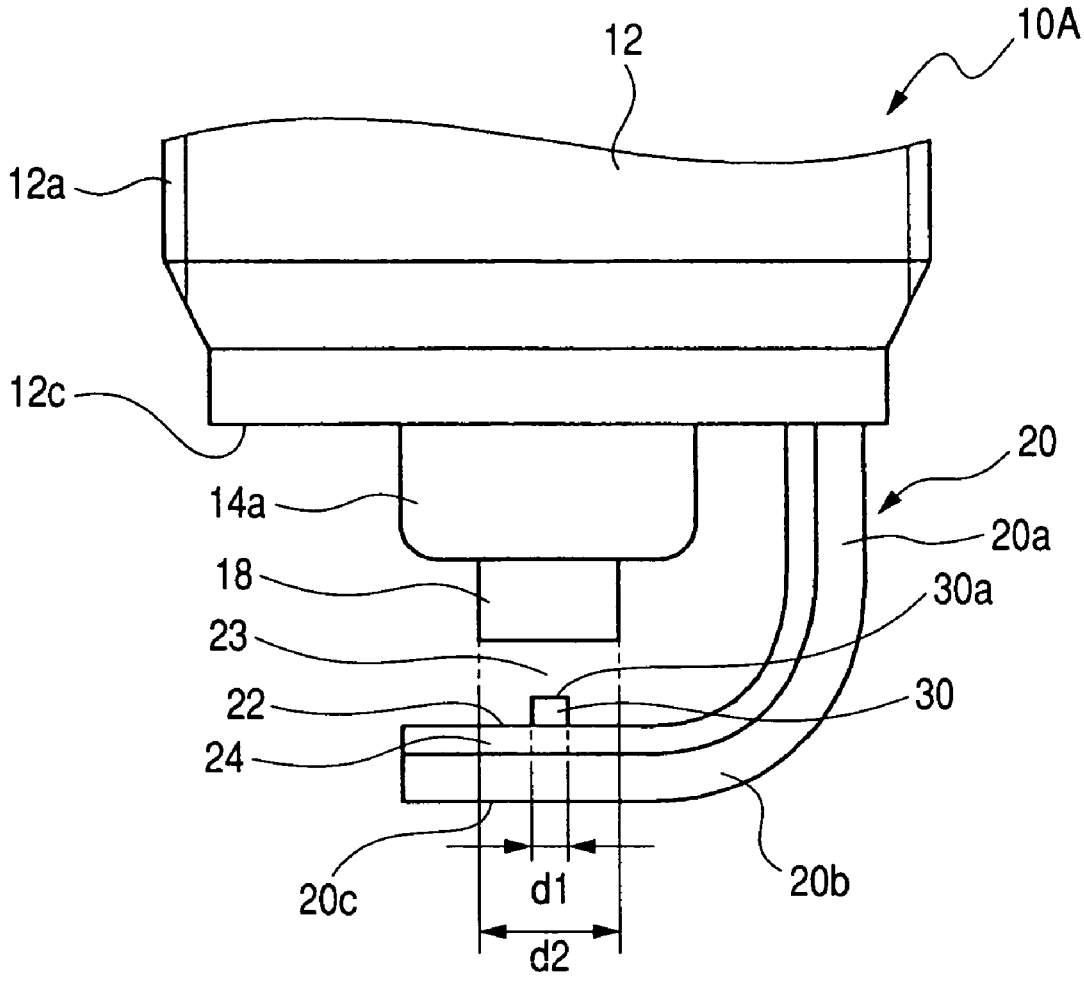
FIG. 2 is an enlarged side view showing a vicinity of an igniting area of the spark plug shown in FIG. 1.
Figure 3:
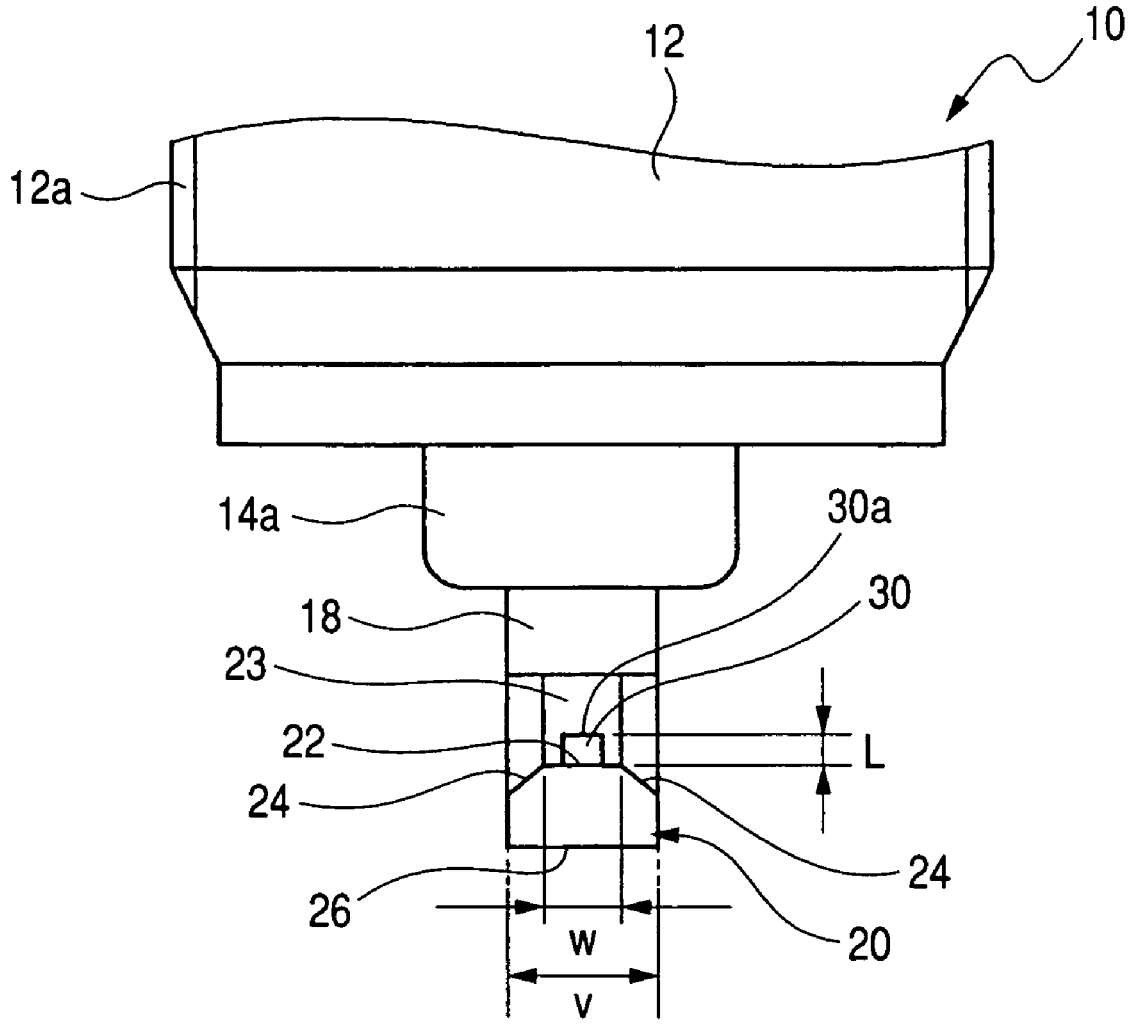
FIG. 3 is an enlarged front view showing the vicinity of the igniting area of the spark plug shown in FIG. 1.

As shown in FIGS. 1 to 3, the spark plug 10 includes a cylindrical metal shell 12, made of electrically conductive steel (such as low carbon steel), which has a lower portion having an outer circumferential periphery formed with a mounting thread 12*a* to be screwed into the engine block (not shown).

Accommodated inside the metal shell 12 is a porcelain insulator 14, made of for instance alumina ceramic, which is fixedly supported with the metal shell 12 in coaxial relationship therewith in alignment with a central axis M. The porcelain insulator 14 has one end 14*b* that protrudes outward from one end 12*b* of the metal shell 12 and a distal end 14*a* protruding out of a distal end 12*c* of the metal shell 12.

The porcelain insulator 14 has a lower portion formed with an axial bore 14*c* that fixedly retains a center electrode 16 in an electrically insulated state.

As shown in FIG. 1, the center electrode 16 has one distal end 18 that protrudes from the distal end 14*a* of the porcelain insulator 14. Thus, the center electrode 16 is fixedly held in the metal shell 12 in an electrically insulated state under a condition where the distal end 18 protrudes from the distal end 12*c* of the metal shell 12.

Meanwhile, a ground electrode 20 extends from the distal end of the metal shell 12. With the presently filed embodiment, as best shown in FIGS. 2 and 3, the ground electrode 20 takes the form of a rectangular columnar configuration. More particularly, the ground electrode 20 of the presently filed embodiment has one distal end 20*a* fixedly secured to the distal end 12*c* of the metal shell 12 by welding, a middle portion 20*b* bent in a substantially L-shaped configuration, and the other distal end 20*c* laterally extending from the middle portion 20*b*. The other distal end 20*c* has a facing surface 22 placed in face-to-face relationship with the distal end 18 of the center electrode 16 with a spark discharge gap 23.

As shown in FIG. 3, the facing surface 22 has a width "w" selected to lie in a value equal to or greater than 0.6 mm and equal to or less than 1.6 mm.

As shown in FIG. 3, the ground electrode 20 has the maximum width "v" greater than a width "w" of the facing surface 22. Further, the ground electrode 20 has downwardly sloped chamfered portions 24, 24 on both sides of the facing surface 22. The chamfered portions 24, 24 play roles as fuel-adhesion escape wall surfaces to avoid fuel from being adhered onto the facing surface 22, permitting the spark plug 10 to have elongated operating life with increase reliability.

With the present embodiment, in particular, the ground electrode 20 has a rectangular body, shaped in a hexagonal shape in cross section, which has one side formed with the chamfered portions 24, 24. With such a structure, the facing surface 22 is formed between the pair of chamfered portions 24, 24. In addition, the ground electrode 20 has a bottom wall portion 26 in a position opposite to the facing surface 22 and has a width equal to the width "v" but less than the width "w" of the facing surface 22.

Further, a noble metal chip 30, serving as a spark discharge member, is joined to the facing surface 22 of the ground electrode 20 by laser welding or resistance welding and protrudes into the spark discharge gap 23 such that the noble metal chip 30 is placed in face-to-face relationship with the distal end of the center electrode 16. The noble metal chip 30 is preferably made of Pt (white gold or platinum) or alloy containing PT as a principal component. Meanwhile, the ground electrode 20 is made of base material such as Ni alloy and the noble metal chip 30 is welded to the ground electrode 20 as mentioned above.

The noble metal chip 30 is formed in a columnar shape and has an outer diameter d1 in a value ranging from 0.4 to 1.0 mm with an axial length L set in a value ranging from 0.3 to 1.5 mm.

Meanwhile, the distal end 18 of the center electrode 16 has a columnar shape with an outer diameter d2 greater than 2 mm in a value ranging from, for instance, 2.3 to 2.5 mm. In addition, the center electrode 16 is made of Ni-alloy (Nickel alloy).

The distal end 18 of the center electrode 16 and the noble metal chip 30 are placed in a coaxial relationship in substantially alignment with the central axis M, defining therebetween the spark discharge gap 23 in a distance ranging from approximately 0.6 to 1.5 mm.

Further, the mounting thread 12*a* of the metal shell 12 may preferably have a value ranging from M10 to M14 under JIS (Japanese Industrial Standard).

Next, the operation of the spark plug 10 of the present embodiment will be described below.

With the spark plug 10 mounted on an engine in a combustion chamber (not shown) thereof, the combustion chamber is supplied with fuel and air to form an air-fuel mixture. Under such a condition, a high voltage is applied across the center electrode 16 and the noble metal chip 30 of the ground electrode 30. At this moment, a spark discharge takes in the spark discharge gap 23 between the center electrode 16 and the noble metal chip 30 of the ground electrode 30. This results in ignition of the air-fuel mixture, which is then caused to explode in the combustion chamber. When this takes place, the air-fuel mixture, tending to be adhered onto the facing surface 22 of the ground electrode 20, escapes from the facing surface 22 with the aid of the chamfered portions 24, 24 serving as the fuel-adhesion escape wall surfaces. This is particularly effective because the facing surface 22 of the ground electrode 20 is set to have the width with a value W less than 1.6 mm. Therefore, the facing surface 22 of the ground electrode 20 has a lessened area than the bottom wall portion 26 and fuel is caused to flow out of the spark discharge gap 23 into an area away therefrom via the chamfered portions 24, 24. Thus, even if fuel flows to an area around the facing surface 22 of the ground electrode 20, the chamfered portions 24, 24, formed on both sides of the facing surface 22 of the ground electrode, cause fuel to flow from the facing surface 22 in sidewise directions. This enables the suppression of fuel from fuel clamping on the facing surface 22. This makes it possible to highly improve ignitability and startability of the spark plug 10.

Further, since the facing surface 22 of the ground electrode 20 has the width "w" greater than 0.6 mm, the temperature rise of facing surface 22 of the ground electrode 20 can be eliminated. This results in capability of minimizing the wear of the ground electrode 20.

Furthermore, as shown in FIG. 3, the maximum width "v" of the ground electrode 20 in cross section, including the facing surface 22 in cross section, is greater than the width "w" of the facing surface 22. That is, the ground electrode 20 has the hexagonally cross-sectional configuration with the chamfered portions 24, 24 being formed on both sides of the facing surface 22. This makes it possible for the ground electrode 20 to be formed in an adequate cross-sectional area even if the facing surface 22 is formed in the narrowed width. Thus, the spark plug 10 can be formed in a structure that ensures wear resistance of the ground electrode 20 with an increase in fuel-accumulation resistance and fuel bridging resistance.

Moreover, the facing surface 22 of the ground electrode 20 supports thereon the noble metal chip 30 that protrudes into the spark discharge gap 23. With the structure of the spark plug 10 discussed above, since fuel is hard to build up in an area between the center electrode 16 and the facing surface 22, no obstacle is present on a surface of the facing surface 22, enabling the prevention of the occurrence of fuel accumulation and fuel bridging. Thus, the occurrence of fuel accumulation and fuel bridging that disturb spark discharge. This allows the spark plug 10 to have improved ignitability and startability. In addition, the use of the noble metal chip 30 per se allows the spark plug 10 to be further improved in ignitability and durability.

Further, due to the noble metal chip 30 determined in the outer diameter d1 of the value from 0.4 to 10 mm, the noble metal chip 30 can ensure wear resistance and ignitability. In addition, since the noble metal chip 30 has an axial length L in a value ranging from 0.3 to 1.5 mm, the noble metal chip 30 can have improved ignitability while ensuring oxidation resistance.

Furthermore, since the distal end portion of the center electrode 16 has the outer diameter d2 of the value greater than 2 mm, the center electrode 16 can ensure increased wear resistance, thereby enabling the provision of the spark plug 10 having increased long operating life. In general, a spark plug, having a center electrode whose distal end has an outer diameter equal to or greater than 2 mm, is liable to suffer the occurrence of fuel clamping and fuel bridging between the center electrode and the ground electrode. On the contrary, with the spark plug 10 of the present embodiment to which the present invention is applied, the spark plug 10 can be obtained in a structure that can suppress fuel accumulation and fuel bridging.

As set forth above, the present embodiment makes it possible to provide a spark plug for an internal combustion engine, with the spark plug having fuel clamping resistance and fuel bridging resistance.

Second Embodiment

Figure 4:
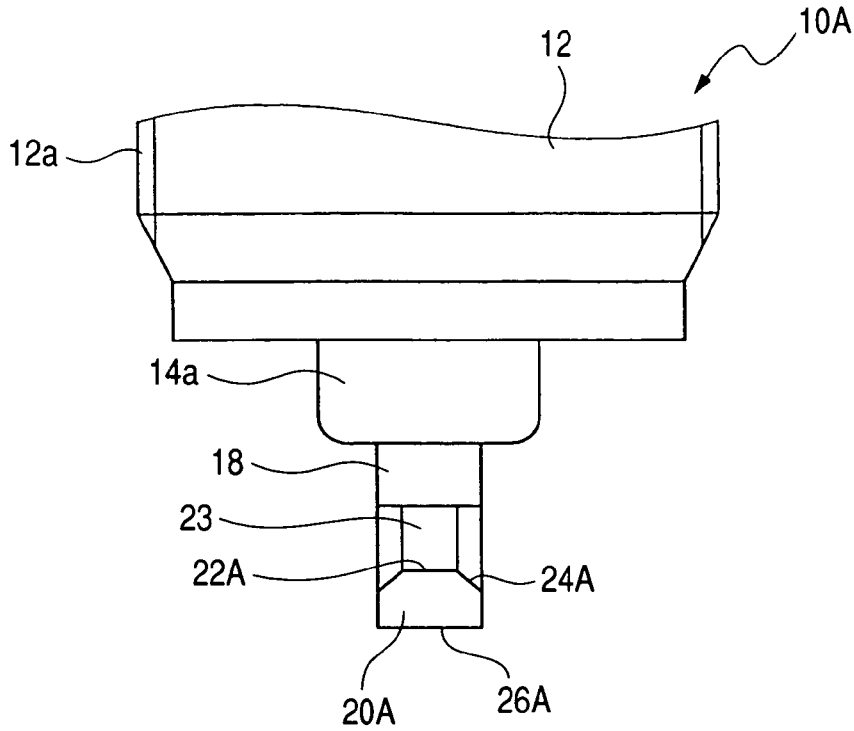
FIG. 4 is an enlarged front view showing a vicinity of an igniting area of a spark plug of a second embodiment according to the present invention.
Figure 5:
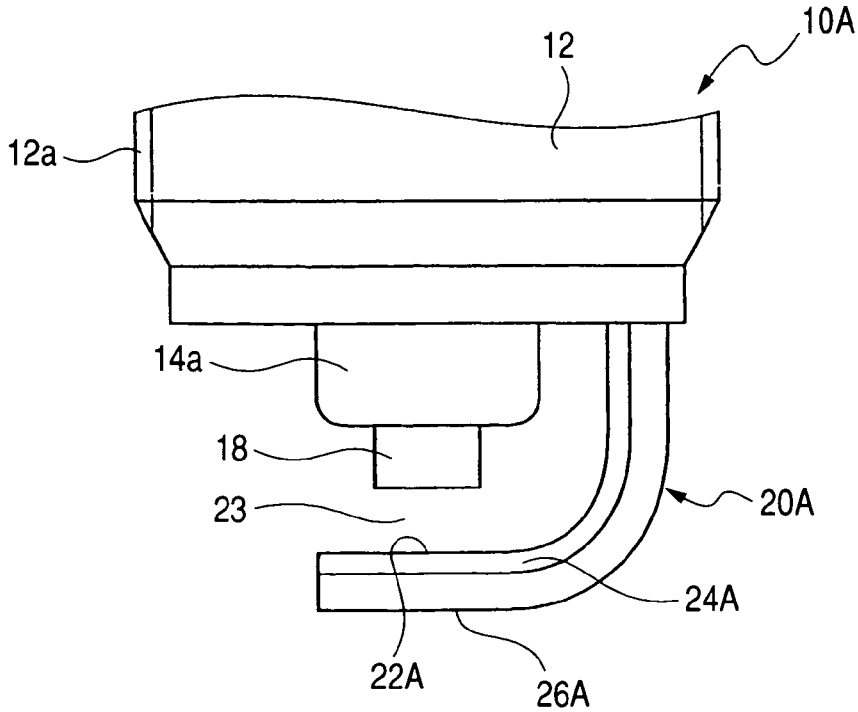
FIG. 5 is an enlarged side view showing a vicinity of an igniting area of the spark plug shown in FIG. 4.

A spark plug of a second embodiment is described below with reference to FIGS. 4 and 5. FIG. 4 is an enlarged front view showing the spark plug of the present embodiment. FIG. 5 is an enlarged side view of the spark plug of the present embodiment.

As shown in FIGS. 4 and 5, the spark plug 10A comprises a ground electrode 20A that has no noble metal chip.

With the spark plug 10A of the present embodiment, a spark discharge gap 23 is provided between a distal end of a center electrode 16 and a facing surface 22A of an end portion of the ground electrode 20A. The facing surface 22A is set to have the same width "w", laying in a value equal to or less than 1.6 mm, as that of the facing surface 22 of the ground electrode 22 of the first embodiment.

The spark plug 10A is similar in other structure to the spark plug 10 of the first embodiment and, so, description of the same structure is herein omitted for the sake of simplification.

With the present embodiment, no need arises for the noble metal chip to be joined to the ground electrode 20A, thereby enabling a reduction in manufacturing process and a reduction in production cost.

Even with the spark plug 10A of the present embodiment, since the facing surface 24A of the ground electrode 20A has the width "w" equal to or less than 1.6 mm, the spark plug 10A can have improved fuel clamping resistance and fuel bridging resistance.

The spark plug 10A of the present embodiment has the same other advantages as those of the spark plug 10 of the first embodiment and, therefore, redundant description of these advantages is herein omitted.

Third Embodiment

Figure 6:
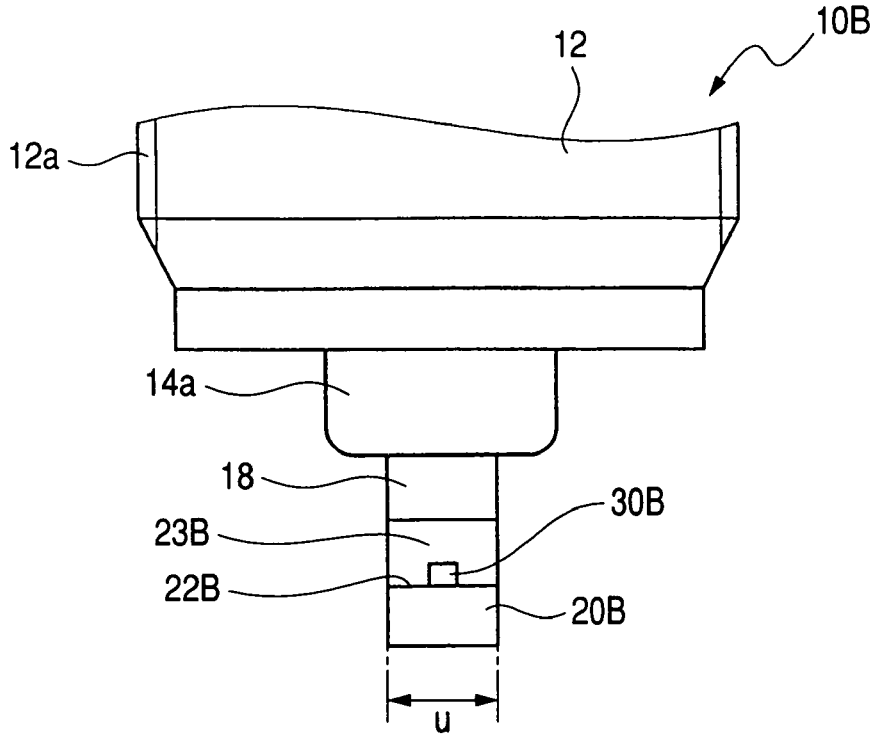
FIG. 6 is an enlarged front view showing a vicinity of an igniting area of a spark plug of a third embodiment according to the present invention.
Figure 7:
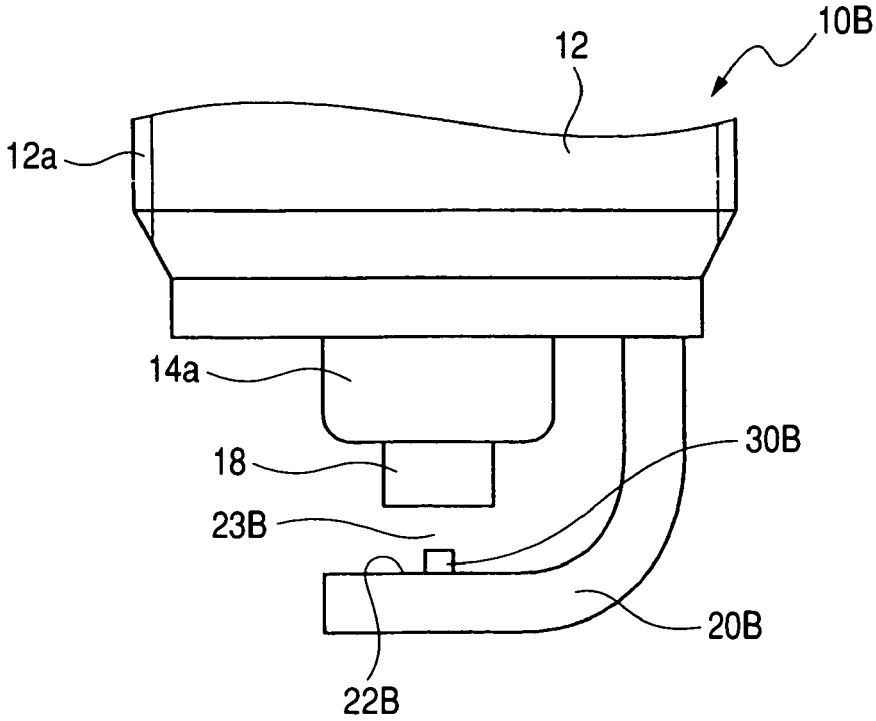
FIG. 7 is an enlarged side view showing the vicinity of the igniting area of the spark plug shown in FIG. 6.

A spark plug of a third embodiment is described below with reference to FIGS. 6 and 7. FIG. 6 is an enlarged front view showing the spark plug of the present embodiment. FIG. 7 is an enlarged side view of the spark plug of the present embodiment.

As shown in FIGS. 6 and 7, the spark plug 10B comprises a ground electrode 20B, formed in a rectangular shape in cross section, which has a facing surface 22B on which a noble metal chip 30B is joined so as to protrude in a spark discharge gap 23B in face-to-face relationship with a distal end of a center electrode 16.

With such a structure of the spark plug 10B of the present embodiment, the facing surface 22B of the ground electrode 20B is set to have a width "u" falling in a value from 2.2 to 2.8 mm.

The spark plug 10B of the present embodiment has the same other advantages as those of the spark plug 10 of the first embodiment and, therefore, redundant description of these advantages is herein omitted.

With the spark plug 10B of the present embodiment, the facing surface 22B of the ground electrode 20B carries thereon the noble metal chip 30B that protrudes in the spark discharge gap 23B. Therefore, even if fuel is adhered onto the ground electrode 22B and caused to flow to an area around the facing surface 22B of the ground electrode 20B, fuel is hard to accumulate on the facing surface 22B. This enables the minimization of the occurrence of fuel clamping and fuel bridging which disturb an ark discharge spark. This enables the spark plug 10B to have improved ignitability and startability.

As set forth above, even the present embodiment enables the provision of a spark plug for an internal combustion engine to have improved fuel clamping resistance and fuel bridging resistance.

Fourth Embodiment

Figure 8:
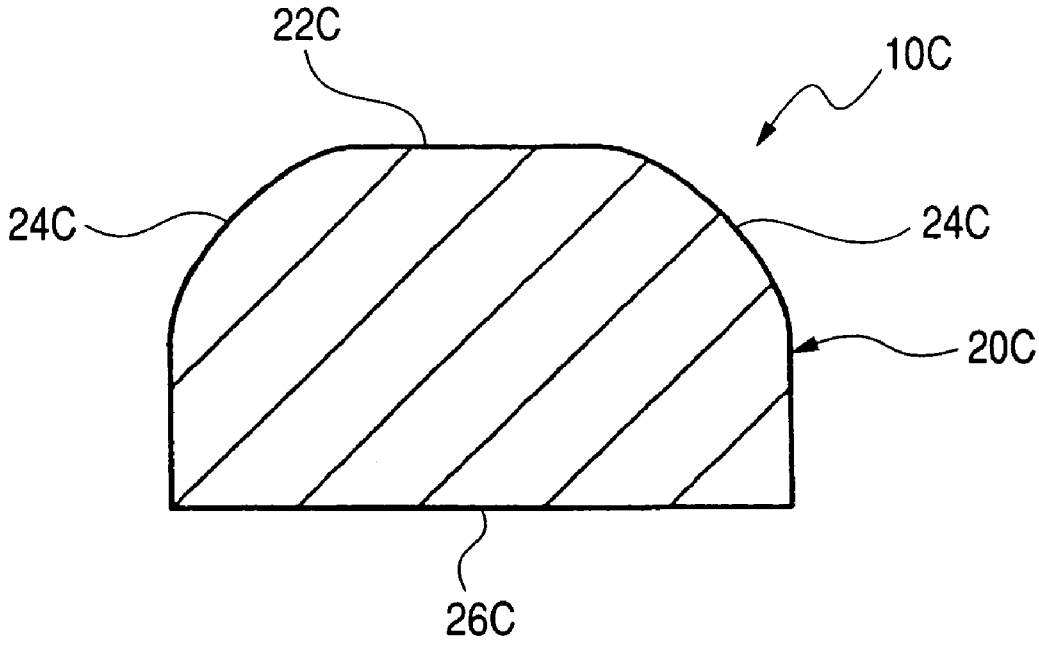
FIG. 8 is a cross sectional view showing a ground electrode forming a part of a spark plug of a fourth embodiment according to the present invention.

A spark plug of a fourth embodiment is described below with reference to FIG. 8. FIG. 8 is a cross-sectional view showing the spark plug of the present embodiment.

As shown in FIG. 8, the spark plug 10C comprises a ground electrode 20C having a substantially trapezoid shape in cross section. That is, the ground electrode 20C has a facing surface 22C, placed to be face-to-face relation with a distal end of a center electrode (not shown), and a bottom wall 26C with both upper corner portions having chamfered portions 24C each formed in a circular arc shape.

The spark plug 10C has the same other component parts as those of the spark plug 10 of the first embodiment and, hence, redundant description of the same is herein omitted.

Figure 9:
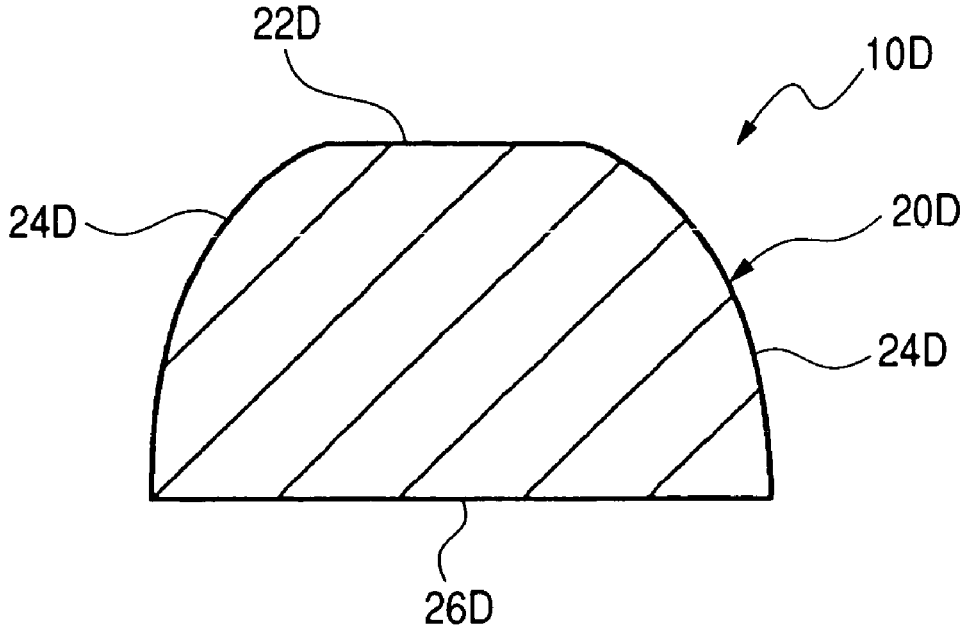
FIG. 9 is a cross sectional view showing a modified form of the ground electrode forming the part of the spark plug of the fourth embodiment according to the present invention.

FIG. 9 shows a first modified form of the spark plug 10C shown in FIG. 8. In this modified form, a spark plug 10D comprises a ground electrode 20D having a facing surface 22D, placed to be face-to-face relation with a distal end of a center electrode (not shown), and a bottom wall 26D. With such a structure, the ground electrode 20 D has both side walls formed in circular arc shapes, respectively.

(Second Modification)

Figure 10:
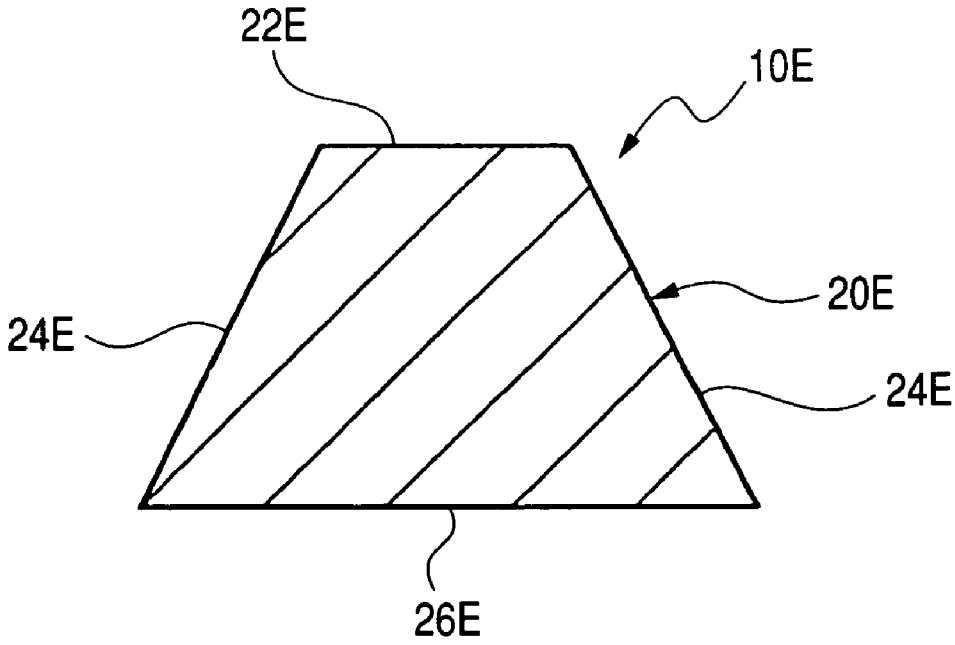
FIG. 10 is a cross sectional view showing another modified form of the ground electrode forming the part of the spark plug of the fourth embodiment according to the present invention.

FIG. 10 shows a second modified form of the spark plug 10C shown in FIG. 8. In this modified form, a spark plug 10D comprises a ground electrode 20 E having a facing surface 22E, placed to be face-to-face relation with a distal end of a center electrode (not shown), and a bottom wall 26E. With such a structure, the ground electrode 20 E has both sidewalls formed in inclined (tapered) shapes, respectively, such that the spark plug 10E has a trapezoid shape in cross section.

(Third Modification)

Figure 11:
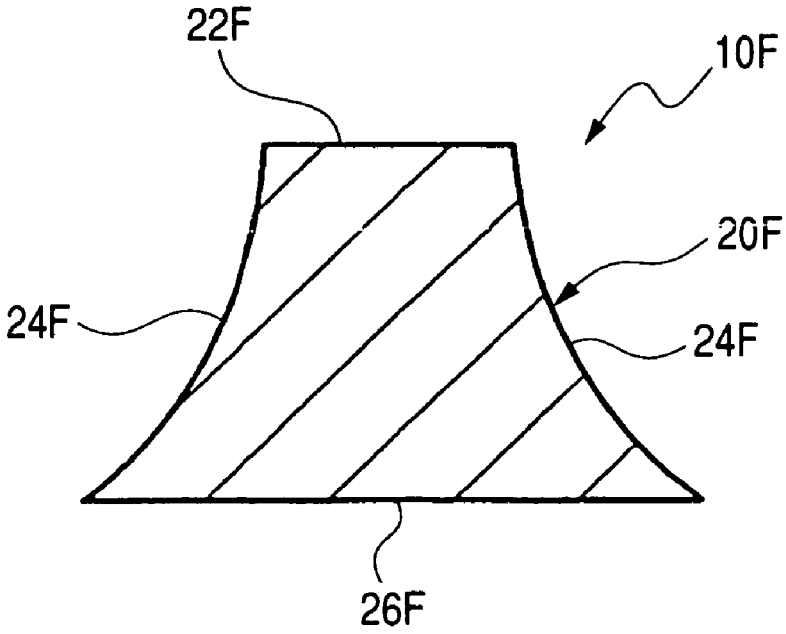
FIG. 11 is a cross sectional view showing still another modified form of the ground electrode forming the part of the spark plug of the fourth embodiment according to the present invention.

FIG. 11 shows a third modified form of the spark plug 10C shown in FIG. 8. In this modified form, a spark plug 10F comprises a ground electrode 20F having a facing surface 22F, placed to be face-to-face relation with a distal end of a center electrode (not shown), and a bottom wall 26F. With such a structure, the ground electrode 20F has both sidewalls formed in inwardly dent circular arc shapes, respectively, such that the spark plug 10F generally has a trapezoid shape in cross section.

The modified forms of the ground electrodes 20C to 20F shows various examples of structural shapes of the ground electrodes and may take the form of a variety of other variations. Further, the ground electrodes 20C to 20F of the spark plugs may carry thereon noble metal chips in the same structure as those of the spark plugs of the thirst and third embodiments (see FIGS. 1 to 3 and FIGS. 6 and 7).

The spark plugs 10D to 10F have the same other component parts as those of the spark plug 10 of the first embodiment and, hence, redundant description of the same is herein omitted.

Fifth Embodiment

Figure 12:
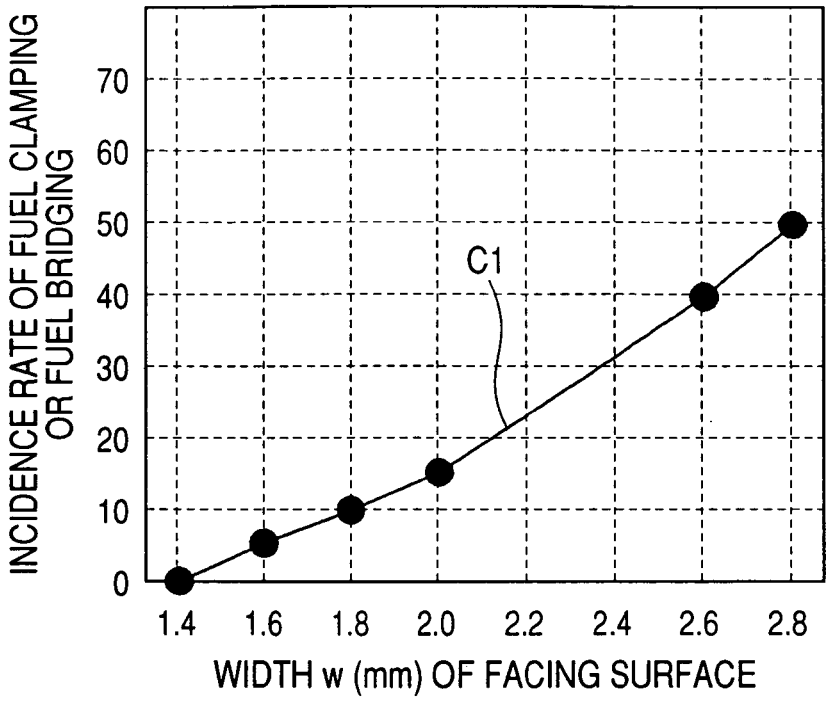
FIG. 12 is a graph showing the relationship between a width of a facing surface of the ground electrode and an incidence rate of a fuel clamping rate or a fuel bridging rate caused in a spark plug of a fifth embodiment according to the present invention.

FIG. 12 is a graph showing an incidence ratio of fuel clamping and fuel bridging in terms of a width "w" of the facing surface 22A of the ground electrode 20A.

In the present embodiment, the spark plugs were prepared as specimens each with the same structure as that of the second embodiment shown in FIGS. 4 and 5 and each had no noble metal chip carried on the ground electrode 20A. In addition, the distal end 18 of the center electrode 16 had a diameter "d" of 2.5 mm.

Six kinds of spark plugs were prepared with the ground electrodes having the facing surfaces with widths formed in difference sizes in values from 1.4 to 2.8 mm. These spark plugs were placed under environments at an extremely low temperature of −30° C. and ignited to generate spark discharges one hundred times. Among the spark discharges effectuated one hundred times, observations were made to check how many times the fuel clamping and fuel bridging occur.

In FIG. 12, a curve C1 shows the graph in which observation results are plotted.

As will be apparent from FIG. 12, the spark plug suffers the occurrence of fuel clamping and fuel bridging such that the larger the width "w" of the facing surface 22A of the ground electrode 20A, the greater will be the incidence ratio of fuel clamping and fuel bridging. With the spark plug having the ground electrode whose facing surface is less than 1.6 mm, the resulting incidence ratios becomes less than 10% and the incidence ratio of fuel bridging is zeroed. Furthermore, with the spark plug having the ground electrode whose facing surface has a width equal to or less than 1.4 mm, an incidence rate of fuel clamping or fuel bridging can be zeroed, i.e., at 0%.

Thus, these results demonstrate that the use of the ground electrode 20A, formed with the facing surface 22A whose width "w" is set to be less than 1.6 mm, allows the spark plug 10A to have remarkably improved fuel clamping resistance and fuel bridging resistance.

Sixth Embodiment

Figure 13:
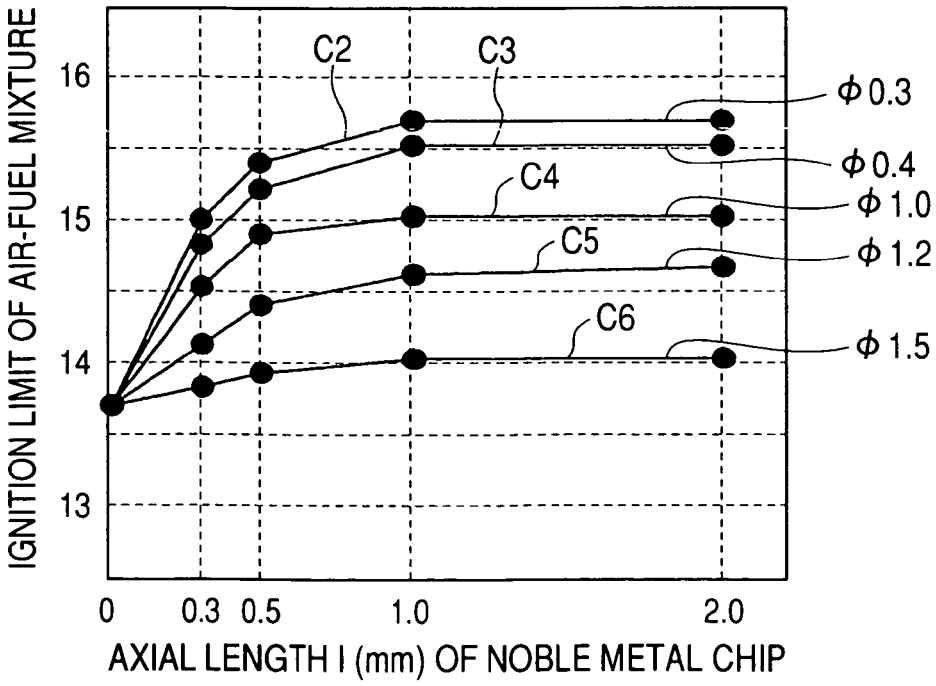
FIG. 13 is a graph showing the relationship between an axial length of a noble metal chip joined to the ground electrode and a related ignitability of a spark plug of a sixth embodiment according to the present invention.

FIG. 13 is a graph showing an ignitability limit of air-fuel mixture in terms of an axial length L (protruding distance) and an outer diameter d1 of the noble metal chip joined to the facing surface 22B of the ground electrode 20B.

In the present embodiment, the spark plugs were prepared as specimens each with the same structure as that of the third embodiment shown in FIGS. 6 and 7. In addition, the noble metal chips were prepared with diameters "d" of 0.3 to 1.5 mm and lengths of 0.3, 0.5, 1.0 and 2.0 mm. These spark plugs were placed under environments at an extremely low temperature of −30° C. and ignited to generate spark discharges one hundred times.

FIG. 13 shows the graph in which observation results are plotted.

In FIG. 13, curves C2 to C6, related to the noble metal chips with diameters of 0.3 to 1.5 mm, respectively, show variations in the ignitability limits in terms of the axial lengths of the noble metal chips.

As will be apparent from the curves C2 to C6 of the graph in FIG. 13, the ignitability limit of the spark plug varies such that the longer the axial length and the smaller the diameter d1 of the noble metal chip 30B, the higher will be the ignitability of the spark plug 10B. The use of the noble metal chip 30B selected to be less than 1.0 mm in diameter enables the spark plug 10B to have adequately improved ignitability. In addition, although the use of the noble metal chip 30B selected to have a reduced diameter d1 enables the spark plug 10B to have improved ignitability, the use of the noble metal chip selected be less than 0.4 mm in diameter causes a risk to increase of a deterioration in wear resistance due to increased operating temperatures. For this reason, the noble metal chip may preferably have a diameter d1 greater than 0.4 mm.

Moreover, in order to ensure increased ignitability, the noble metal chip may preferably have an axial length L greater than 0.3 mm.

Seventh Embodiment

Figure 14:
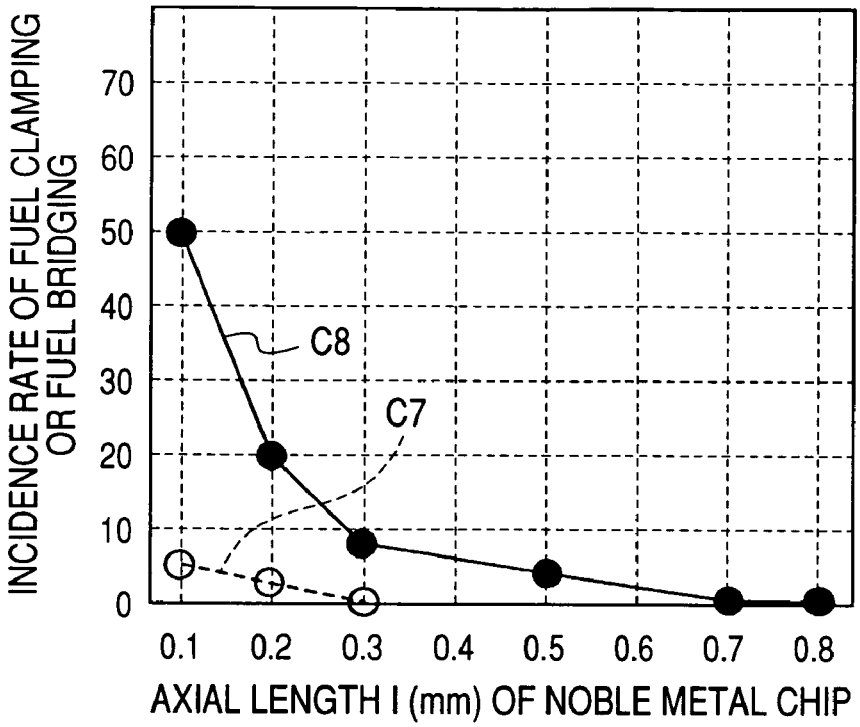
FIG. 14 is a graph showing the relationship an axial length of a noble metal chip joined to the ground electrode and an incidence rate of a fuel clamping rate or a fuel bridging rate caused in a spark plug of a seventh embodiment according to the present invention.

FIG. 14 is a graph showing an incidence ratio of fuel clamping and fuel bridging in terms of an axial length of a noble metal chip of a ground electrode of a spark plug of the type shown in the first and third embodiments.

In the present embodiment, the spark plug of the type shown in the first embodiment (see FIGS. 1 to 3) was prepared as a specimen whose ground electrode had a facing surface set to the width "w" of 1.6 mm. In addition, the spark plug of the type shown in the third embodiment (see FIGS. 6 and 7) was prepared as a specimen whose ground electrode had a facing surface set to the width "w" of 2.8 mm. Moreover, the center electrodes of both the spark plugs had distal ends had the distal ends whose outer diameters d2 were set to 2.5 mm.

FIG. 14 shows the graph in which observation results are plotted.

In FIG. 14, curves C7 and C8 show the incidence ratios of fuel clamping and fuel bridging of the spark plugs corresponding to those of the first and third embodiments, respectively.

As will be apparent from the curves C7 and C8 of the graph in FIG. 14 the incidence ratios of fuel clamping and fuel bridging of the spark plugs vary such that the longer the axial length of the noble metal chip, the lower will be the incidence ratios of fuel clamping and fuel bridging of the spark plugs.

The specimen of the type corresponding to the first embodiment can achieve a remarkable reduction in the incidence ratio of fuel clamping and fuel bridging of the sparks plug and the use of the noble metal chip selected to have an axial length L set to be greater than 0.3 mm allows the suppression of fuel clamping and fuel bridging of the spark plug.

Meanwhile, with the specimen of the type corresponding to the spark plug of the third embodiment (see FIGS. 6 and 7), the spark plug had increased incidents of fuel clamping and fuel bridging and, in particular, with the spark plug employing the noble metal chip with an axial length L selected to be less than 0.2 mm, the spark plug had a remarkably increased incident of fuel bridging. However, with the spark plug having the noble metal chip with the axial length L set to be greater than 0.3 mm, the incident ratios of the fuel clamping and fuel bridging could be reduced to a value less than 10%.

Eighth Embodiment

Figure 15:
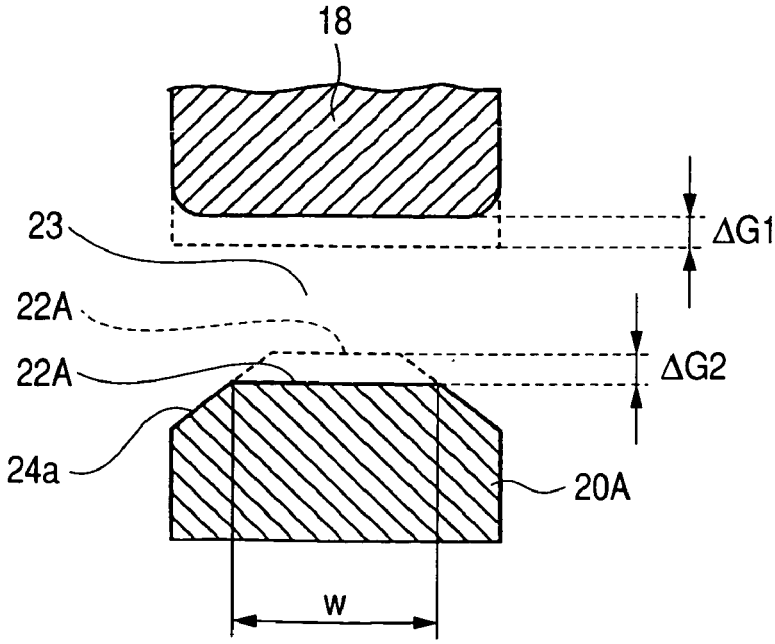
FIG. 15 is a cross sectional view showing a center electrode and a ground electrode forming parts of a spark plug of an eighth embodiment according to the present invention.

A specimen of a seventh embodiment was conducted using spark plug with spark discharge gaps set in various sizes to check the relationship between the width "w" of the facing surface 22A of the ground electrode 20A and wasting amounts ΔG of the spark discharge gap 24. Also, the specimen used in this example was of the type corresponding to the second embodiment shown in FIGS. 4 and 5 with the same component parts as those of the second embodiment bearing like reference numerals. With the present Example, various tests were conducted using spark plugs with the ground electrodes 20A having width "w" set in various sizes and the spark plugs were subjected to durability tests for 300 hours using a four-cylinder type engine bench with 1600 cc. Thereafter, as shown in FIG. 15, the wasting amount ΔG of the spark discharge gaps 24 of the respective spark plugs were measured. That is, the wasting amount ΔG of the spark discharge gap 24 includes a sum of a wasting amount ΔG1 of the center electrode 16 and a wasting amount ΔG2 of the ground electrode 20A. In addition, dotted lines in FIG. 15 represent shapes of the center electrode 16 and the ground electrode 20A before durability tests have been conducted.

Figure 16:
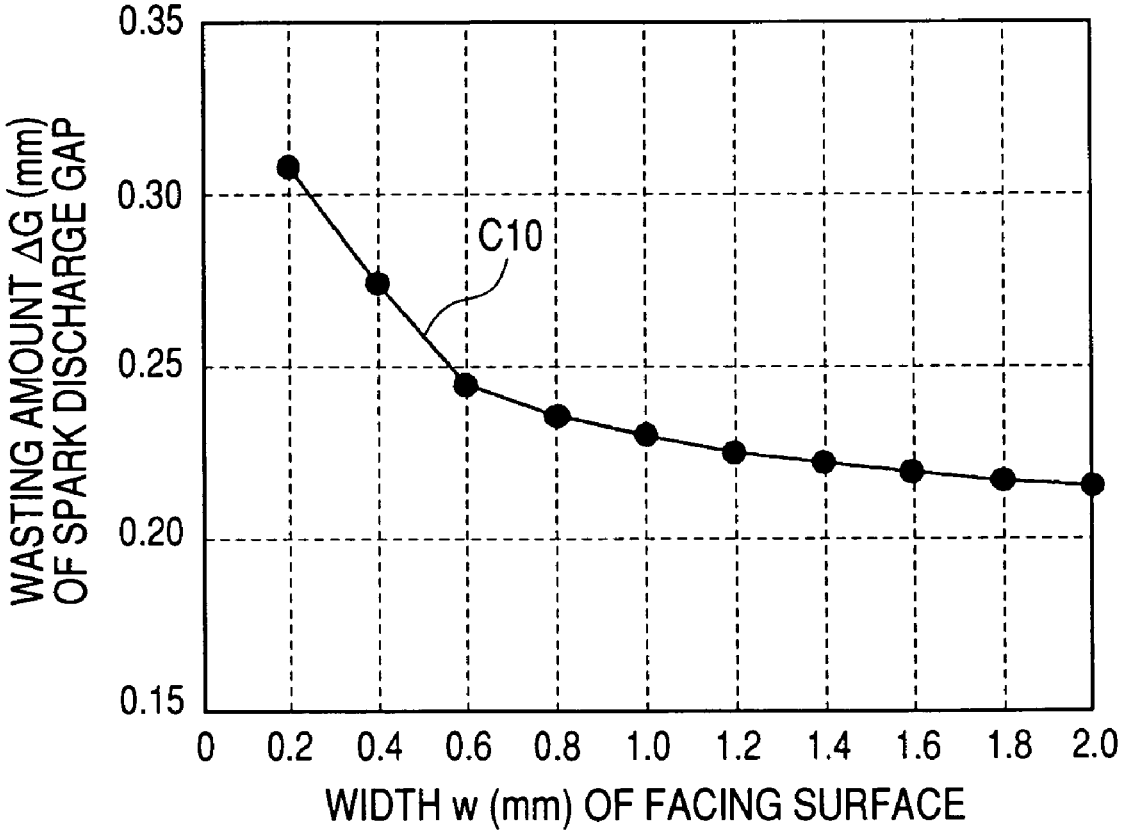
FIG. 16 is a graph showing the relationship between a width of a facing surface of a ground electrode and an increasing ratio of a spark discharge gap.

Test results are plotted in FIG. 16.

As will be apparent from FIG. 16, the wasting amount ΔG of the spark discharge gap varies such that the smaller the width "w" of the facing surface 22A of the ground electrode 20A, the greater will be the wasting amount ΔG of the spark discharge gap. It is conceived that such a phenomenon occurs because as the width "w" of the facing surface 22A decreases, a spark discharge surface area of the ground electrode 20A decreases. That is, when making a comparison between a facing surface "w" set in an increased value and a facing surface "w" set in a decreased value, the electrode wastes away in a direction to increase the spark discharge gap 24 with a decrease in the width "w" of the facing surface of the ground electrode 20A even if both the center electrode 16 and the ground electrodes waste away in volumes in equal rates.

It will be further appreciated from a curve 10 in a graph of FIG. 16 that the smaller the width "w" of the facing surface 22A of the ground electrode 20A, the greater will be the increasing rate of the wasting amount ΔG of the spark discharge gap. This seems to be derived from a reason in that if the width "w" of the facing surface 22A of the ground electrode 20A becomes less than 0.6 mm, the temperature of the facing surface 22A of the ground electrode 20A remarkably increases with the resultant further increase in the wasting rate of the ground electrode 20A.

With the above, it will be appreciated that the facing surface 22A of the ground electrode 20A is preferably set to be greater than 0.6 mm on the ground of effects of suppressing the temperature rise of the facing surface 22A of the ground electrode 20A for thereby minimizing the wasting of the ground electrode 20A.

(Advantageous Effects of Embodiments)

With the spark plug of the embodiment set forth above, the ground electrode may have a maximum width in cross section, involving the facing surface, which is greater than the width of the facing surface.

With such a structure of the spark plug, even if the facing surface of the ground electrode is narrowed, the facing surface of the ground electrode can have an adequate cross-sectional structure, making it possible to provide highly improved fuel clamping resistance and fuel bridging resistance while ensuring wear resistance of the ground electrode.

With the spark plug of the present embodiment, the ground electrode has sidewalls whose corners are formed with chamfered portions, respectively.

With such a structure, it becomes easy for the spark plug to have the ground electrode having an adequately ensured cross-sectional area while having the facing surface formed in a narrowed width. This results in capability for the spark plug to easily have increased fuel clamping resistance and fuel bridging resistance while ensuring wear resistance of the ground electrode.

With the spark plug of the present embodiment, further, the ground electrode may include a noble metal chip supported on the facing surface so as to protrude into the spark discharge gap.

With the spark plug formed in the structure having the noble metal chip, fuel becomes hard to be adhered onto the facing surface on which the noble metal chip is joined. This prevents fuel from clamping on the facing surface of the ground electrode. This effectively suppresses the occurrence of fuel bridging between the noble metal chip and the distal end of the center electrode. Thus, the spark plug can have highly improved ignitability and startability. In addition, the use of the noble metal chip per se allows the spark plug to be expected to have improved ignitability and startability.

With the spark plug of the present embodiment, furthermore, the facing surface of the ground electrode may have the width equal to or greater than 0.6 mm.

Such a ground electrode arranged to have the given width results in capability of minimizing an excessive temperature rise of the facing surface of the ground electrode. This enables the minimization of wear of the ground electrode. This results in capability of preventing a reduction in operating life of the spark plug.

With the spark plug of the present embodiment, the ground electrode may include a noble metal chip, supported on the facing surface so as to protrude into the spark discharge gap, and the distal end of the center electrode is directly exposed to the spark discharge gap in face-to-face relationship with the facing surface of the ground electrode.

With such a structure of the spark plug, the noble metal chip is placed on the facing surface of the ground electrode so as to protrude into the spark discharge gap. Therefore, even if fuel is adhered onto the surface of the ground electrode and fuel flows to the facing surface of the ground electrode in an area around the spark discharge gap, fuel is hard to clamp on the facing surface in an area facing the distal end of the center electrode. This result in capability of suppressing the occurrence of fuel clamping and the occurrence of fuel bridging that disturb spark discharge between the center electrode and the ground electrode. This enables the spark plug to have highly improved ignitability and startability.

With the spark plug of the present embodiment, the noble metal chip may have an outer diameter falling in a range equal to or greater than 0.4 and equal to or less than 1.0 mm.

With the noble metal chip set to have such a given outer diameter, the noble metal chip can have highly improved wear resistance and the spark plug can have highly improved ignitability.

If the noble metal chip has an outer diameter less than 0.4 mm, the temperatures of the noble metal chip excessively increase during spark discharge, resulting in an increase in wear of the noble metal chip. Meanwhile, if the noble metal chip has an outer diameter greater than 1.0 mm, there is an increased risk for the spark plug to encounter a difficulty in having adequate ignitability. Thus, with the noble metal chip selected to have the outer diameter in such a given range, highly improved wear resistance and highly improved ignitability can be obtained.

With the spark plug of the present embodiment, the noble metal chip may have an axial length falling in a range equal to or greater than 0.3 and equal to or less than 1.5 mm.

With the noble metal chip having the axial length set in such a given range, the spark plug can have highly improved ignitability while ensuring oxidation resistance of the noble metal chip.

If the noble metal chip has an axial length less than 0.3 mm, an increased risk occurs for the spark plug to encounter a difficulty in ensuring improved ignitability. Meanwhile, if the noble metal chip has an axial length greater than 1.5 mm, the spark plug encounters a difficulty in adequately ensuring oxidation resistance of the noble metal chip.

With the spark plug of the present embodiment, the distal end of the center electrode may have an outer diameter falling in a range equal to or greater than 2 mm.

With the center electrode formed in the outer diameter of such a given value, the center electrode can have highly elongated operating life while ensuring oxidation resistance of the center electrode. Further, with the spark plug employing the center electrode having the distal end with the outer diameter greater than 2 mm, the spark plug is generally liable to suffer fuel clamping and fuel bridging. Selecting the center electrode whose distal end has the outer diameter greater than 2 mm enables the spark plug to be free from fuel clamping and fuel bridging.

With the spark plug of the present embodiment, the ground electrode may have a maximum width in cross section, involving the facing surface, which is greater than the width of the facing surface and the ground electrode may have sidewalls whose corners are formed with chamfered portions, respectively. The ground electrode may include a noble metal chip supported on the facing surface so as to protrude into the spark discharge gap.

With such a structure of the spark plug, the facing surface of the ground electrode is set to have the width equal to or less than 1.6 mm. In addition, the ground electrode has the maximum width in cross section greater than the width of the facing surface. Moreover, the ground electrode has the sidewalls formed with the respective chamfered portions on both sides of the facing surface. Such a structure of the spark plug enables fuel to be hard to adhere onto the facing surface of the ground electrode in the area around the spark discharge gap. Thus, the spark plug becomes free from the occurrence of fuel clamping and fuel bridging. Accordingly, the spark plug can have highly improved ignitability even under circumstances used in extremely low temperature environments, while having extended operating life.

With the spark plug of the present embodiment, the noble metal chip may nave an outer diameter falling in a range equal to or greater than 0.4 and equal to or less than 1.0 mm.

With the noble metal chip having such a given outer diameter, the noble metal chip can have highly improved wear resistance and the spark plug can have highly improved ignitability.

With the outer diameter of the noble metal chip selected to lie in a value less than 0.4 mm, the temperatures of the noble metal chip excessively increase during spark discharge, resulting in an increase in wear of the noble metal chip. Meanwhile, if the outer diameter of the noble metal chip is greater than 1.0 mm, there is an increased risk for the spark plug to encounter a difficulty in having adequate ignitability. Thus, with the noble metal chip selected to have the outer diameter in such a given range, the spark plug can have highly improved wear resistance and highly improved ignitability.

With the spark plug of the present embodiment, the noble metal chip may have an axial length falling in a range equal to or greater than 0.3 and equal to or less than 1.5 mm.

With the noble metal chip having the axial length set in such a given range, the spark plug can have highly improved ignitability while ensuring oxidation resistance of the noble metal chip.

If the axial length of the noble metal chip is selected to be less than 0.3 mm, an increased risk occurs for the spark plug to encounter a difficulty in ensuring improved ignitability. Meanwhile, if the axial length of the noble metal chip is selected to be greater than 1.5 mm, the spark plug encounters a difficulty in adequately ensuring oxidation resistance of the noble metal chip.

With the spark plug of the present embodiment, the ground electrode may have a maximum width in cross section, involving the facing surface, which is greater than the width of the facing surface and the ground electrode may have sidewalls whose corners are formed with chamfered portions, respectively. The distal end of the center electrode is directly exposed to the spark discharge gap in face-to-face relationship with the facing surface of the ground electrode.

With such a structure, the spark plug can have the ground electrode having an adequately ensured cross-sectional area-while having the facing surface formed in a narrowed width. This results in capability for the spark plug to easily have increased fuel clamping resistance and fuel bridging resistance while ensuring wear resistance of the ground electrode.

With the spark plug of the present embodiment, the ground electrode may have a maximum width in cross section, involving the facing surface, which is greater than the width of the facing surface, and the ground electrode may include a noble metal chip supported on the facing surface so as to protrude into the spark discharge gap.

With such a structure of the spark plug, even if the facing surface of the ground electrode is narrowed, the facing surface of the ground electrode can have an adequate cross-sectional structure, making it possible to provide highly improved fuel clamping resistance and fuel bridging resistance while ensuring wear resistance of the ground electrode.

With the spark plug of the present embodiment, the noble metal chip may have an outer diameter falling in a range equal to or greater than 0.4 and equal to or less than 1.0 mm.

With the noble metal chip set to have such a given outer diameter, the noble metal chip can have highly improved wear resistance and the spark plug can have highly improved ignitability.

With the spark plug of the present embodiment, the noble metal chip may have an axial length falling in a range equal to or greater than 0.3 and equal to or less than 1.5 mm.

With the noble metal chip having the axial length set in such a given range, the spark plug can have highly improved ignitability while ensuring oxidation resistance of the noble metal chip.

With the spark plug of the present embodiment, the ground electrode may have a maximum width in cross section, involving the facing surface, which is greater than the width of the facing surface, and the ground electrode may have sidewalls whose corners are formed with circular arc shaped chamfered portions, respectively.

With such a structure, the spark plug can easily have the ground electrode with an adequately ensured cross-sectional area while having the facing surface formed in a narrowed width. This enables the spark plug to easily have increased fuel clamping resistance and fuel bridging resistance while ensuring wear resistance of the ground electrode.

With the spark plug of the present embodiment, the ground electrode may have a maximum width in cross section, involving the facing surface, which is greater than the width of the facing surface, and the ground electrode has sidewalls formed in circular arc shaped configurations, respectively.

With the ground electrode having the sidewalls formed in such circular arc configurations, fuel can easily escape from the facing surface along the sidewalls of the ground electrode. This promotes the prevention of fuel clamping and fuel bridging. Thus, the spark plug can ensure highly improved ignitability for an extended long time period, providing a long operating life.

With the spark plug of the present embodiment, the ground electrode may have a maximum width in cross section, involving the facing surface, which is greater than the width of the facing surface, and the ground electrode has sidewalls formed in tapered configurations, respectively, with respect to the facing surface.

With the ground electrode having the sidewalls formed in such tapered configurations, fuel can easily escape from the facing surface along the sidewalls of the ground electrode. This promotes the prevention of fuel clamping and fuel bridging. Thus, the spark plug can ensure highly improved ignitability for an extended long time period, providing a long operating life.

With the spark plug of the present embodiment, the ground electrode may have a maximum width in cross section, involving the facing surface, which is greater than the width of the facing surface, and the ground electrode may have sidewalls formed in inwardly dent configurations, respectively.

With the ground electrode having the sidewalls formed in such inwardly dent configurations, fuel can easily escape from the facing surface along the sidewalls of the ground electrode. This prevents the occurrence of fuel clamping and fuel bridging. Thus, the spark plug can ensure highly improved ignitability for an extended long time period, providing a long operating life.

While the specific embodiment of the present invention has been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. A spark plug for an internal combustion engine, comprising:

a metal shell having an outer periphery formed with a mounting thread;

a porcelain insulator fixedly secured to the metal shell on a central axis thereof with a distal end located outside the porcelain insulator; and a ground electrode joined to the metal shell and having an end spaced from the distal end of the center electrode to define therebetween a spark discharge gap;

wherein the ground electrode includes a facing surface intersecting the central axis of the center electrode and having a width equal to or less than 1.4 mm;

the ground electrode includes a noble metal chip supported on the facing surface at a position inward of a distal end of the ground electrode so as to protrude into the spark discharge gap;

the noble metal chip has an outer diameter falling in a range equal to or greater than 0.4 mm and equal to or less than 1.0 mm;

the noble metal chip has an axial length falling in a range equal to or greater than 0.3 mm and equal to or less than 1.5 mm;

the distal end of the center electrode has an outer diameter falling in a range equal to or greater than 2 mm;

the ground electrode has a maximum width in cross section, involving the facing surface, which is greater than the width of the facing surface; and the ground electrode has sidewalls whose corners are formed with chamfered portions, respectively.

2. The spark plug according to claim 1, wherein:

the facing surface of the ground electrode has the width equal to or greater than 0.6 mm.

3. The spark plug according to claim 1, wherein:

the distal end of the center electrode is directly exposed to the spark discharge gap in face-to-face relationship with the facing surface of the ground electrode.

4. The spark plug according to claim 1, wherein:

the sidewalls has corners formed with circular arc shaped chamfered portions, respectively.

5. The spark plug according to claim 1, wherein:

the sidewalls formed in circular arc shaped configurations, respectively.

6. The spark plug according to claim 1, wherein:

the sidewalls formed in tapered configurations, respectively, with respect to the facing surface.

7. The spark plug according to claim 1, wherein:

the sidewalls formed in inwardly dent configurations, respectively.

* * * * *